United States Patent [19]

Dewulf et al.

[11] 4,286,140

[45] Aug. 25, 1981

[54] APPARATUS FOR RAISING A LIQUID TO A GIVEN TEMPERATURE

[75] Inventors: Roger Dewulf, Bures sur Yvette; Jean-Luc Denis, Sceaux; Michel Germain, Marcoussis; Christian Lecointre, Carnetin, all of France

[73] Assignee: Commissariat a l'Energie Atomique, Paris, France

[21] Appl. No.: 18,335

[22] Filed: Mar. 7, 1979

[30] Foreign Application Priority Data

Mar. 21, 1978 [FR] France ..... 78 08115

[51] Int. Cl.[3] ..... F24H 1/22

[52] U.S. Cl. ..... 219/306; 219/305; 219/368; 165/156

[58] Field of Search ..... 219/306, 307, 367, 368, 219/305, 379–382; 165/128–130, 102, 156

[56] References Cited

U.S. PATENT DOCUMENTS

| | | | |
|---|---|---|---|
| 1,358,982 | 11/1920 | Papini | 219/307 |
| 1,671,677 | 5/1928 | Keeton | 219/306 |
| 1,767,122 | 6/1930 | Dean . | |
| 2,438,865 | 3/1948 | Rehard . | |
| 2,775,683 | 12/1956 | Kleist . | |
| 4,147,923 | 4/1979 | Davis et al. | 219/368 |

FOREIGN PATENT DOCUMENTS

| | | | |
|---|---|---|---|
| 642005 | 5/1962 | Canada | 219/306 |
| 44509 | 11/1938 | Netherlands . | |
| 463578 | 4/1937 | United Kingdom | 219/306 |

*Primary Examiner*—B. A. Reynolds
*Assistant Examiner*—Bernard Roskoski
*Attorney, Agent, or Firm*—Kerkam, Stowell, Kondracki & Clarke

[57] ABSTRACT

An apparatus for raising a liquid to a given temperature and for controlling and regulating this temperature has a vertical cylindrical enclosure, a vertical tube housing a heating resistor, and a first and a second ferrule located in this order between the tube and the enclosure to define a first, a second and a third annular space. The first ferrule is connected to the lower wall of the enclosure. The tube and the second ferrule are connected to the upper wall of the enclosure. The liquid is supplied to the lower portion of the first space and extracted from the upper portion of the third space. The length of the resistor is shorter by at least one quarter of the height of the tube and orifices in the lower portion of the first ferrule produce a thermosiphon effect between the first and second annular spaces.

6 Claims, 1 Drawing Figure

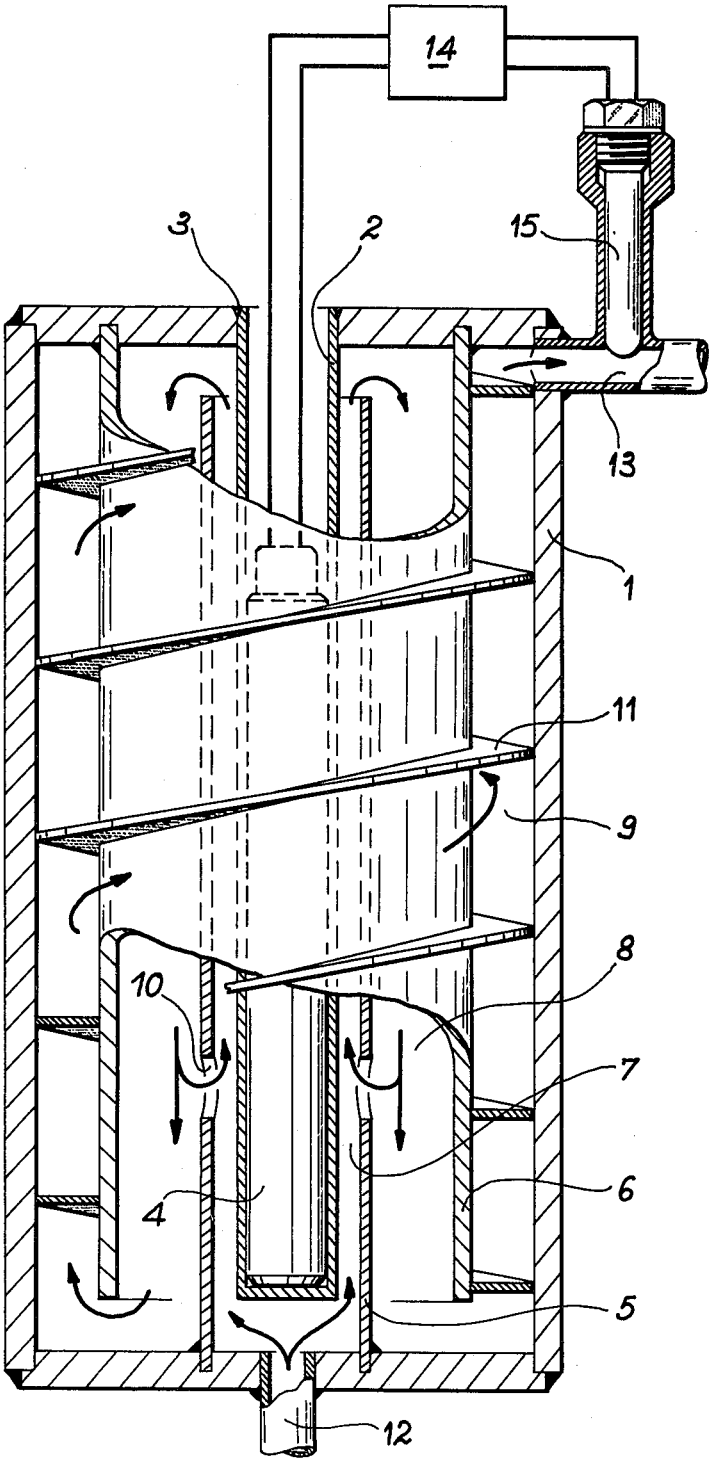
14
3
2
15
13
1
11
9
8
10
7
6
4
5
12

APPARATUS FOR RAISING A LIQUID TO A GIVEN TEMPERATURE

BACKGROUND OF THE INVENTION

The present invention relates to an apparatus for raising a liquid to a given temperature and for controlling and regulating in a constant and accurate manner the temperature to which the said liquid has been raised.

This apparatus can be used for heating each of the liquid phases entering each of the ends of a liquid-liquid extraction column and for accurately regulating the temperature thereof.

It is known that an aqueous acid solution is used for example for reextracting uranium or plutonium previously fixed by an organic solution such as tributyl phosphate or trilauryl amine, said liquid - liquid reextraction taking place in a column in which the two solutions are in countercurrent. In such liquid - liquid extractions columns it is necessary that each of the two liquid phases introduced respectively at the lower end and at the upper end of the extraction column at a given flow rate is at a particular temperature and that said temperature remains as constant as possible to within a few tenths of a °C.

To raise each of the phases to the desired temperature and to maintain said temperature constant a heating element, such as an electrical resistor has been brought into direct contact with each of these phases. However, it has been found that in this case there is a deterioration of the liquid phases which is liable to seriously prejudice the quality of the chemical exchangers during the exchange cycles.

BRIEF SUMMARY OF THE INVENTION

The apparatus according to the invention solves the above-indicated problems and in particular makes it possible to raise a liquid to a given temperature without there being direct contact with a heating element and in that it makes it possible to control and regulate in a constant and accurate manner the temperature to which the liquid has been heated.

The problem of the invention is solved by an apparatus which comprises within a tight vertical cylindrical enclosure a vertical tube which is sealed at its base and connected at its upper end to the upper wall of said enclosure and in which is placed a heating resistor, the length of the latter being smaller by at least one quarter of the height of the tube, whilst two concentric ferrules of said tube are placed between the wall of the tube and the wall of the enclosure, the ferrule adjacent to said tube being free in its upper portion and connected in its lower portion to the lower wall of the enclosure and the ferrule adjacent to the wall of the enclosure being free in its lower portion and connected by its upper portion to the upper wall of the enclosure, said ferrules successively defining between the tube wall and the enclosure wall a first thin annular space for the upwards circulation of the liquid, a second annular space for the descending circulation of the liquid and a third annular space for the ascending circulation of the liquid, the ferrule separating the first annular space from the second annular space having in its lower portion a plurality of radially distributed orifices, whilst the second annular space is substantially wider than the first annular space, the third annular space being provided with means for rendering homogeneous the temperature of the liquid and wherein it also comprises means for supplying liquid to the lower portion of the first annular space and means for extracting the liquid from the upper portion of the third annular space, as well as means for controlling and maintaining constant the temperature to which the said liquid leaves the apparatus.

According to a feature of the invention the means for controlling and maintaining constant the temperature at which the liquid leaves the apparatus comprise a regulator which is connected on the one hand to the heating resistor and on the other to a resistance probe which is linked with the liquid leaving the apparatus.

According to another feature of the present apparatus the second annular space is at the most five times wider than the first annular space.

According to an embodiment of the apparatus according to the invention the means for rendering the temperature of the liquid in the third annular space homogeneous comprise turns whose axis is parallel to the axis of the enclosure and which are disposed helically from bottom to top of said third annular space.

In the apparatus in question the means for supplying the liquid to the lower portion of the first annular space comprise a vertical pipe which issues into the bottom of said annular space in which the liquid is brought to a particular flow rate by means of a pump. The means for extracting the liquid from the upper part of the third annular space comprise a horizontal pipe issuing into the upper portion of the said third annular space. The radially distributed orifices in the lower portion of the ferrule separating the first annular space from the second annular space are for example circular orifices.

DESCRIPTION OF THE DRAWING AND PREFERRED EMBODIMENTS

The invention will be described in greater detail hereinafter with reference to non-limitative embodiments and the drawing which diagrammatically shows in cross-section an embodiment of the present apparatus.

The drawing shows the vertical cylindrical enclosure 1 in which is placed a vertical tube 2 sealed at its base and connected by its upper end at 3 to the upper wall of enclosure 1. The heating resistor 4, whose length is smaller by at least one quarter than the height of tube 2 is placed in the latter.

Two ferrules 5 and 6 are placed between the wall of tube 2 and the wall of enclosure 1 and define a first annular space 7, a second annular space 8 and a third annular space 9. The ferrule 5 adjacent to tube 2 is free at its upper end and is connected by its lower portion to the lower wall of enclosure 1. Ferrule 6 adjacent to the wall of enclosure 1 is free in its lower portion and is connected by its upper portion to the upper wall of enclosure 1. The first annular space 7 between tube 2 and ferrule 5 is very thin, its width being of the order of 6 mm. In its lower portion ferrule 5 has radially distributed circular recycling orifices 10. The second annular space 8 is substantially wider than the first annular space and is in fact at the most five times wider than the first space, namely in the specific case approximately 30 mm. The third annular space 9 is provided with turns 11 whose axis is parallel to the axis of enclosure 1 and which are helically disposed from bottom to top.

The pipe 12 for introducing liquid into the apparatus issues into the lower end of the first annular space 7. The pipe 13 for extracting the liquid which has been raised to a certain temperature issues into the upper portion of the third annular space 9.

A regulator 14 is connected on the one hand to resistor 4 and on the other to a resistance probe 15 linked with pipe 13.

The different elements constituting the apparatus according to the invention may be made either from a metal or an alloy such as stainless steel or from different types of elastomer.

The apparatus according to the invention functions in the following manner.

The liquid which is to be heated to a certain temperature is introduced at the bottom of annular space 7 by means of a pipe 12 and is brought to a particular flow rate by means of a not shown pump. In view of the small diameter of annular space 7 as the liquid rises in tube 2 it heats in such a way that its flow rate and speed increase. This leads to a vacuum being produced at the bottom of annular space 7. The liquid then passes to the upper portion of annular space 8 where it circulates more slowly from bottom to top due to the difference in the cross-sections between annular spaces 7 and 8. Due to the vacuum created at the bottom of annular space 7 a certain quantity of liquid arriving in the lower portion of annular space 8 is recycled into annular space 7 through orifices 10 until a temperature balance occurs. The assembly comprising spaces 7 and 8, orifices 10 and heating resistor 4 thus fulfills a thermosiphon function which obviates the deterioration of the liquid, more particularly in the case of a decrease in the flow rate of the liquid introduced by pipe 12.

Under the pressure of the flow the liquid which has reached a certain temperature passes at the lower portion of the second annular space 8 into the third annular space 9 where it circulates from bottom to top and finally leaves at a particular temperature via pipe 13. The liquid temperature is rendered homogeneous in annular space 9 by means of turns 11.

It should be noted that the thermosiphon function permitted by the presence of orifices 10 results from the vacuum created at the bottom of annular space 7. The double cause of this vacuum is the small cross-section of space 7 and the fact that the liquid which is to be brought to a given temperature issues at the bottom of space 7 in the vicinity of heating resistor 4, which creates a large temperature gradient between the top and bottom of annular space 7. Thus, if the liquid circulated in the opposite direction within the apparatus shown in the drawing, i.e. from outer annular space 9 towards inner annular space 7 the temperature gradient between the ends of the latter will be substantially reduced in such a way that the thermosiphon effect would be very small.

Throughout the operation of the apparatus as a result of the presence of resistance probe 15 regulator 14 detects possible variations in the temperature of the liquid leaving in pipe 13 and, as a function of the information given by resistance probe 15, transmits the necessary correction signals to heating resistor 4.

An apparatus of the type described hereinbefore having a useful volume of 262 centiliters can be used for a liquid flow rate which can reach 20 liters per hour using a 400 Watt resistor. For a flow rate of 10 liters per hour the dwell time of the liquid in the apparatus is 90 seconds.

Thus, as a result of the apparatus according to the invention the liquid which is to be raised to a particular temperature is not in permanent contact with the heating element, which obviates any deterioration in the quality of the liquid. At the outlet a substantially constant temperature is obtained and in the case of slight variations in the temperature on leaving the apparatus there is a permanent correction so that the value is maintained completely constant. Moreover the apparatus according to the invention has the advantage of having very small overall dimensions.

The invention is not limited to the embodiments described and represented hereinbefore and various modifications can be made thereto without passing beyond the scope of the invention.

What is claimed is:

1. An apparatus for raising a liquid to a given temperature and for controlling and regulating in a constant and accurate manner the temperature to which the liquid has been raised, wherein said apparatus comprises:

a tight vertical cylindrical enclosure defining a cylindrical wall, including a lower wall and an upper wall;

a vertical tube located within and spaced from said enclosure, said tube having a sealed base and an upper end connected to said upper wall of said enclosure;

a heating resistor within said tube;

a first ferrule concentric to said tube and located between said tube and said enclosure adjacent to said tube, said first ferrule having a free upper portion and a lower portion which is connected to said lower wall of said enclosure;

a second ferrule concentric to said tube and located between said tube and said enclosure adjacent to said cylindrical wall of said enclosure, said second ferrule having a free lower portion and an upper portion connected to said upper wall of said enclosure;

said first ferrule and said second ferrule successively defining from said tube and said cylindrical wall of said enclosure a first thin annular space, a second annular space and a third annular space, said second annular space being substantially wider than said first annular space;

means for rendering the temperature of the liquid homogeneous, said means being located in said third annular space;

means for supplying the liquid to said first annular space;

means for extracting the liquid from said third annular space; and means for controlling and maintaining constant the temperature at which the liquid leaves the apparatus, wherein said apparatus further comprises:

a plurality of radially distributed orifices formed in said lower portion of said first ferrule separating said first annular space from said second annular space, said means for supplying the liquid to said first annular space being in said lower wall of said enclosure to circulate the liquid upwards in said first annular space, downwards in said second annular space and then upwards in said third annular space, and the length of said resistor being smaller by at least one quarter of the height of said tube, whereby said first annular space, said second annular space, said orifices and said heating resistor form a thermosiphon.

2. An apparatus according to claim 1, wherein the means for controlling and maintaining constant the temperature at which the liquid leaves the apparatus comprise a regulator which is connected to the heating resistor and to a resistance probe which is subject to the liquid leaving the apparatus.

3. An apparatus according to claim 1, wherein said second annular space is at the most five times wider than said first annular space.

4. An apparatus according to claim 1, wherein said means for rendering the temperature of the liquid in the third annular space homogeneous comprise turns of a vane whose axle is parallel to the axis of the enclosure and which vane is disposed helically from bottom to top of said third annular space.

5. An apparatus according to claim 1, wherein the means for supplying the liquid to said lower portion of said first annular space comprise a vertical pipe issuing into said bottom of said annular space.

6. An apparatus according to claim 1, wherein said means for extracting the liquid from said upper portion of said third annular space comprise a horizontal pipe issuing into said upper portion of said annular space.

* * * * *